US006512489B2

(12) United States Patent
Boyle

(10) Patent No.: US 6,512,489 B2
(45) Date of Patent: Jan. 28, 2003

(54) ANTENNA ARRANGEMENT

(75) Inventor: Kevin R. Boyle, Horsham (GB)

(73) Assignee: Knonklijke Phiips Electronics N.V., Eindhoven (NL)

( * ) Notice: Subject to any disclaimer, the term of this patent is extended or adjusted under 35 U.S.C. 154(b) by 0 days.

(21) Appl. No.: 09/885,704

(22) Filed: Jun. 20, 2001

(65) Prior Publication Data

US 2001/0054981 A1 Dec. 27, 2001

(30) Foreign Application Priority Data

Jun. 23, 2000 (GB) ..... 0015374

(51) Int. Cl.[7] ..... H01Q 1/50

(52) U.S. Cl. ..... 343/850; 343/700 MS; 343/852

(58) Field of Search ..... 343/700 MS, 850, 343/852, 860

(56) References Cited

U.S. PATENT DOCUMENTS 4,449,128 A * 5/1984 Weir ..... 333/1.1
4,688,259 A * 8/1987 Edridge ..... 333/1.1
5,999,137 A 12/1999 Crosby ..... 343/725
6,052,085 A 4/2000 Hanson et al. ..... 342/373
6,201,949 B1 * 3/2001 Kich et al. ..... 333/126
6,307,525 B1 * 10/2001 Bateman et al. ..... 333/126

FOREIGN PATENT DOCUMENTS

GB 2311675 A 1/1997 ..... H01Q/5/00
WO WO0011748 2/2000 ..... H01Q/1/24
WO WO0024137 4/2000 ..... H04B/7/04

OTHER PUBLICATIONS

Patent Application GB 000065; Entitled: Dual Band Patch Antenna; Ser. No.: 09/864,131, filing date: May 24, 2001; Inventor: Kevin R. Boyle.

* cited by examiner

*Primary Examiner*—Don Wong
*Assistant Examiner*—Shih-Chao Chen
(74) *Attorney, Agent, or Firm*—Jack D. Slobod; Dicran Halajian

(57) ABSTRACT

A antenna arrangement comprising a multiband antenna having at least one feed point; a multiplexer, the multiplexer comprising reciprocal networks and including at least one output coupled to the at least one feed point of the multiband antenna, the multiplexer further comprising at least one input for receiving at least one signal at a first frequency, wherein the coupling between the at least one feed point and the at least one output of the multiplexer has a substantially negligible impedance.

9 Claims, 6 Drawing Sheets

ANTENNA ARRANGEMENT

BACKGROUND OF THE INVENTION

The present invention relates to an antenna arrangement comprising a multiband antenna having at least one feed point and a multiplexer for connection between the antenna and a transceiver. The present invention further relates to a radio communications apparatus incorporating such an arrangement. In the present specification, the term multiband antenna relates to an antenna which functions satisfactorily in two or more distinct frequency bands but not in the unused spectrum between the bands.

Multiband radio communications apparatuses are becoming increasingly common. For example, cellular telephones are available which can operate in GSM (Global System for Mobile Communications), DCS1800 and PCS1900 (Personal Communication Services) networks. Future apparatus is likely to operate in an even greater range of networks. Implementation of such apparatus requires the availability of multiband antennas and transceivers capable of driving such antennas.

It is conventional for a multiband antenna to be realised as a multi-resonant single feed antenna. There are two common ways of achieving antenna multi-resonance. The first is by having different parts of the antenna structure resonate at different frequencies, for example by the use of two antennas joined at a common feed point. The second is by integrating a transmission line matching structure within the antenna with distributed capacitance and inductance to realise a multi-band matching circuit.

A multiband antenna is normally fed via a multiplexer having one input per frequency band and a single output. The function of the multiplexer is to provide isolation between the various inputs and to provide a known impedance at the inputs which are not in use for a particular frequency band. The multiplexer output drives the antenna via antenna matching circuitry, which must therefore be effective over all frequency bands. The matching circuitry may also perform a broadbanding function, to enhance the bandwidth available from compact antennas such as planar antennas.

A problem with the conventional multiband antenna arrangement described above is that the antenna matching has to be effective at a plurality of frequencies. The more frequencies that are to be matched the more difficult this becomes, which means that the opportunity for other optimisations, such as bandwidth enhancement, is lost.

SUMMARY OF THE INVENTION

An object of the present invention is to provide a multiband antenna arrangement having improved performance.

According to a first aspect of the present invention there is provided an antenna arrangement comprising a multiband antenna having at least one feed point and a multiplexer, the multiplexer comprising at least one input, at least one output and isolation means, the or each output being coupled to a respective antenna feed point, wherein the or each coupling between an antenna feed point and a multiplexer output has a substantially negligible impedance.

By ensuring that the coupling between the antenna and the multiplexer is not influenced by parasitic or other ill-defined discrete components (for example circuit board track impedances), it is ensured the isolating function of the multiplexer is not compromised. The negligible impedance would typically be ensured by implementing the multiplexer and antenna close to one another, possibly on the same substrate. For an antenna having a plurality of feed points, implementation of the multiplexer close to the feed points enhances the isolation between the feed points.

An antenna arrangement made in accordance with the present invention enables the use of antennas having multiple feeds, which has the advantage of allowing the isolation of the feeds from one another and also of allowing individual matching of the feeds. By implementing some or all of the matching between the antenna and a transceiver within the multiplexer, it is possible to have independent matching and bandwidth broadening for each frequency band. As well as being much easier to implement than multiple frequency matching and bandwidth broadening, it allows further bandwidth enhancement via resonant matching circuitry. Further improvements and economies can be realised by sharing of components between matching, bandwidth broadening and multiplexing functions.

According to a second aspect of the present invention there is provided a radio communications apparatus including an antenna arrangement made in accordance with the present invention.

The present invention is based upon the recognition, not present in the prior art, that by having the multiplexer located close to the antenna no significant impedances are present between the antenna and multiplexer. The resultant antenna arrangement has improved performance and is simpler to design than prior art arrangements.

BRIEF DESCRIPTION OF THE DRAWINGS

Embodiments of the present invention will now be described, by way of example, with reference to the accompanying drawings, wherein.

In the drawings the same reference numerals have been used to indicate corresponding features.

DETAILED DESCRIPTION OF THE PREFERRED EMBODIMENTS

Figure 1:
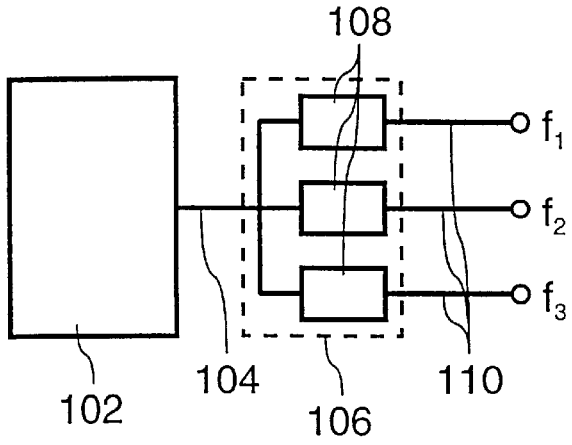
FIG. 1 is a block schematic diagram of an antenna arrangement having a three input, one output multiplexer.

Referring to FIG. 1, an antenna arrangement made in accordance with the present invention comprises a multiband antenna 102 having a single feed 104. The antenna 102 is fed via a multiplexer 106, which multiplexer comprises a plurality of circuits 108. Each circuit 108 is fed by a corresponding input 110 and provides the required isolation between inputs 110, while the outputs of the circuits 108 are combined and applied to the antenna feed 104. In the example shown in FIG. 1 there are three inputs 110, for frequencies $f_1$, $f_2$ and $f_3$ respectively. The circuit connected to the $f_1$ input 110 passes that frequency and prevents signals at the other frequencies, $f_2$ and $f_3$, from being coupled from the antenna feed 104 to the $f_1$ input 110. Each circuit 108 also provides a predetermined terminating impedance at the frequencies of the set $f_1$, $f_2$, $f_3$ which it does not pass.

The circuits 108 could be implemented as resonant circuits, for example comprising either a open circuit series LC circuit or a short circuit parallel LC circuit (or a combination of the two), in either case tuned to be resonant at the input frequencies other than that to be passed. In a Time Division Multiple Access (TDMA) system, the circuits 108 might simply comprise switches.

Matching circuitry, for matching the impedance of a transceiver to that of the antenna 102 and optionally for increasing the bandwidth of the antenna, could be located between the multiplexer 106 and the transceiver. Alternatively, some or all of the matching or bandwidth broadening could be performed in the multiplexer itself, as part of the circuits 108. Such an implementation has the advantage of allowing component sharing between multiplexing, matching and broadbanding functions, giving the possibility of reduced component count and a simpler implementation.

Figure 2:
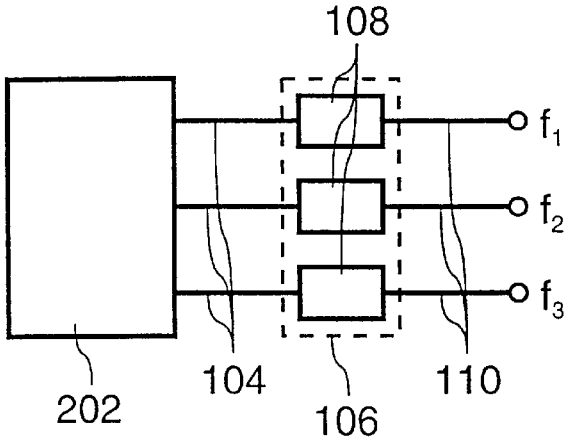
FIG. 2 is a block schematic diagram of an antenna arrangement having a three input, three output multiplexer.

FIG. 2 shows a similar antenna arrangement, comprising a multiband antenna 202 having three feeds 104. In this example the multiplexer 106 is distributed between the feeds 104, and the antenna 202 itself also provides some of the isolation between the inputs 110. The circuits 108 could be implemented in a similar manner to the previous example. By including passive filtering (or even switching) close to the antenna, use of an antenna 202 having multiple feeds is made practical.

In the arrangement of FIG. 2, if the circuits 108 comprise open circuit series LC circuits, each input 110 will present an open circuit to the other inputs 110 at their respective frequencies, so that the antenna 202 will operate as if there is only a single feed at each of the frequencies $f_1$, $f_2$, $f_3$. As well as serving a multiplexing function, this allows the entire volume of the antenna to be used at all three frequencies. The individual feed points of the antenna 202 can then be chosen to provide self-resonance at each frequency using the entire antenna structure, thereby providing improved bandwidth and efficiency. This arrangement also enables more efficient matching than with an antenna having a single feed, in particular allowing independent matching and broadbanding of each feed.

Figure 3:
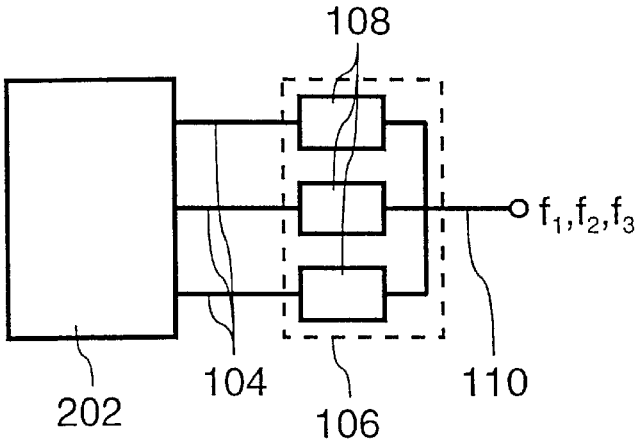
FIG. 3 is a block schematic diagram of an antenna arrangement having a one input, three output multiplexer.

Another variation is illustrated in FIG. 3, in which the multiplexer 106 has a single input 110, shared between frequency bands, and a plurality of outputs connected to the feeds 104 of the multiband antenna 202. In a simple implementation of such a multiplexer 106, each of the circuits 108 comprises open circuit series LC circuits. Each input frequency is then passed by its respective circuit 108 and blocked by the other two circuits 108. As in the arrangement shown in FIG. 2, at each operational frequency the antenna 202 behaves as if there is only a single feed. Such an arrangement could be enhanced by including appropriate matching circuitry within each of the circuits 108, as well as between the multiplexer 106 and the transceiver.

It will be apparent that other variations on the arrangements shown in FIGS. 1 to 3 can be envisaged in which each antenna feed 104 receives signals for one or more operational frequency bands, and similarly each input to the multiplexer receives signals for one or more operational frequency bands. All such variations are within the scope of the present invention.

Figure 4:
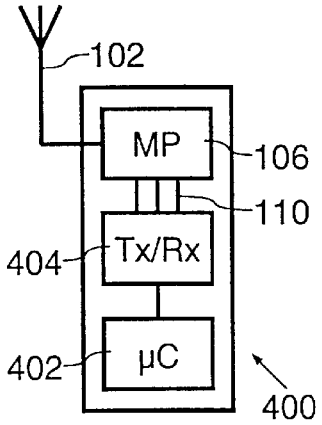
FIG. 4 is a block schematic diagram of a radio communications apparatus incorporating a single output multiplexer.

A radio communications apparatus 400 incorporating a multiplexer 106 having a single output is shown in FIG. 4. The apparatus comprises a microcontroller ($\mu$C) 402, which controls a transceiver (Tx/Rx) 404, which is operable in three frequency bands. The transceiver has three outputs 110, one per frequency band, which comprise the inputs of a multiplexer (MP) 106 having a single output connected to a multiband antenna 102. In this example the matching and broadbanding functions are also performed by the multiplexer 106.

It will be apparent that although the above examples relate to an antenna arrangement for use with three frequency bands, the present invention is not restricted such a use but can be used with any arrangement having two or more frequency bands and corresponding multiplexer (or diplexer) inputs.

Figure 5:
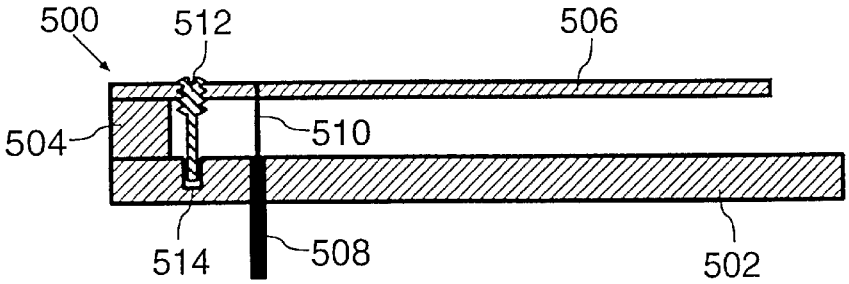
FIG. 5 is a cross-section of a dual-band patch antenna.
Figure 6:
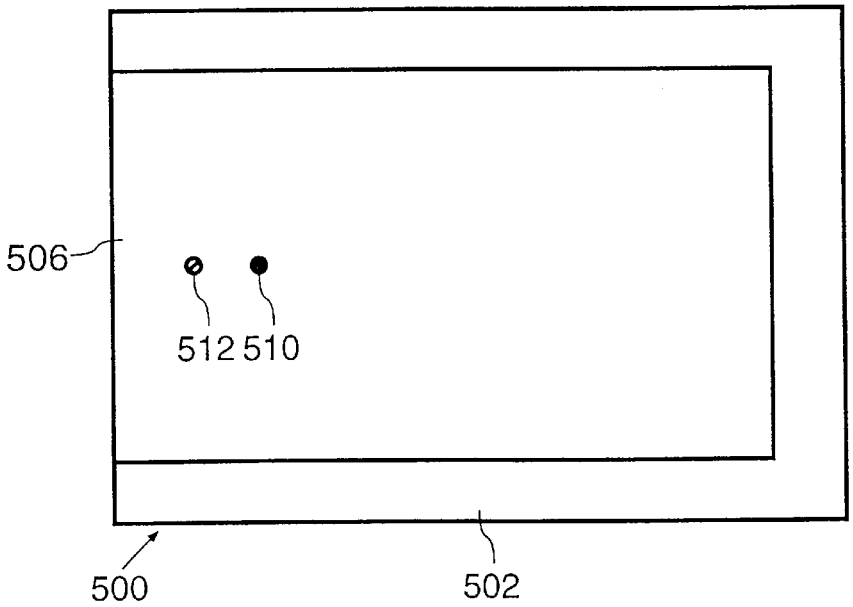
FIG. 6 is a top view of a dual-band patch antenna.

A prototype embodiment of a dual resonant quarter wave patch antenna 500 is shown in cross-section in FIG. 5 and in top view in FIG. 6. Details of the design of such an antenna are disclosed in our co-pending UK Patent Application 0013156.5. The antenna comprises a planar, rectangular ground conductor 502, a conducting spacer 504 and a planar, rectangular patch conductor 506, supported substantially parallel to the ground conductor 502. The antenna is fed via a co-axial cable, of which the outer conductor 508 is connected to the ground conductor 502 and the inner conductor 510 is connected to the patch conductor 506. The cable 510 is connected to the patch conductor 506 at a point on its longitudinal axis of symmetry.

A series resonant circuit between the patch conductor 506 and ground conductor 502 is formed by a mandrel 512 and a hole 514 in the ground conductor 502. The mandrel 512 comprises a threaded brass cylinder, which is turned down to a reduced diameter for the lower portion of its length, which portion of the mandrel 512 is then fitted with a PTFE sleeve to insulate it from the ground conductor.

The threaded portion of the mandrel 512 co-operates with a thread cut in the patch conductor 506, enabling the mandrel 512 to be raised and lowered. The lower portion of the mandrel 512 fits tightly into the hole 514. Hence, a capacitance having a PTFE dielectric is provided by the portion of the mandrel 512 extending into the hole 514, while an inductance is provided by the portion of the mandrel between the ground and patch conductors 502,506. The mandrel is located on the longitudinal axis of symmetry of the conductors 502,506.

Figure 7:
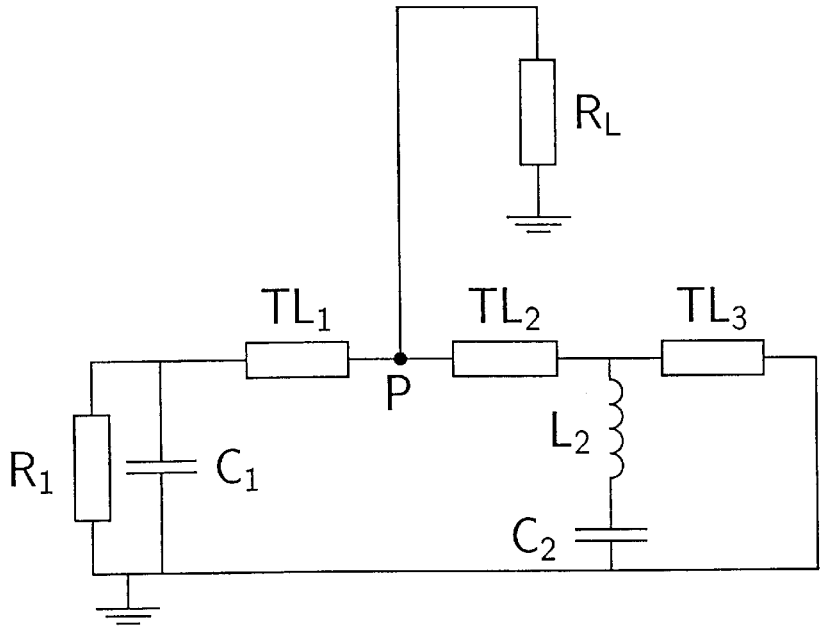
FIG. 7 is an equivalent circuit for modelling the dual-band patch antenna of FIGS. 5 and 6.

A transmission line circuit model, shown in FIG. 7, was used to model the behaviour of the antenna 500. A first transmission line section $TL_1$, having a length of 30.8 mm and a width of 30 mm, models the portion of the conductors 502,506 between the open end (at the right hand side of FIGS. 5 and 6) and the connection of the inner conductor 510 of the coaxial cable. A second transmission line section $TL_2$, having a length of 4.1 mm and a width of 30 mm, models the portion of the conductors 502,506 between the connection of the inner conductor 510 and the mandrel 512. A third transmission line section $TL_3$, having a length of 1.7 mm and a width of 30 mm, models the portion of the conductors 502,506 between the mandrel 512 and the edge of the spacer 504 (which acts as a short circuit between the conductors 502,506).

A resonant circuit is connected from the junction of $TL_2$ and $TL_3$ to ground. The resonant circuit comprises an inductance $L_2$, having a value of 1.95 nH, and a capacitance $C_2$, having a value of 3.7 pF. The resonant circuit has zero impedance at its resonant frequency, $1/(2\pi\sqrt{L_2C_2})=1874$ MHz. In the vicinity of this resonant frequency the behaviour of the patch is modified, while at other frequencies its behaviour is substantially unaffected.

Capacitance $C_1$ represents the edge capacitance of the open-ended transmission line, and has a value of 0.495 pF, while resistance $R_1$ represents the radiation resistance of the edge, and has a value of 1000 Ω, both values determined empirically. A port P represents the point at which the co-axial cable 508,510 is connected to the antenna, and a 50 Ω load, equal to the impedance of the cable 508,510, was used to terminate the port P in simulations.

Figure 8:
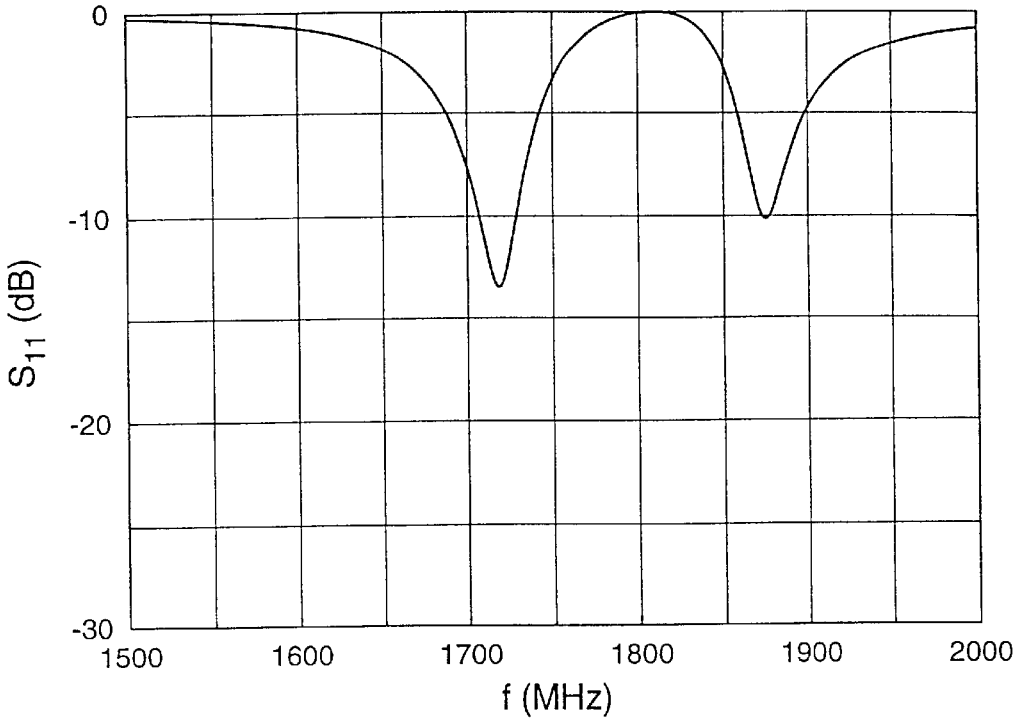
FIG. 8 is a graph of simulated return loss $S_{11}$ in dB against frequency f in MHz for the equivalent circuit of FIG. 7.

FIG. 8 shows the results of simulations for the return loss $S_{11}$ for frequencies f between 1500 and 2000 MHz. There are two resonances, at frequencies of 1718 MHz and 1874 MHz. The lower of these corresponds to the original resonant frequency of the patch antenna reduced by the effect of the resonant circuit, while the higher corresponds to a new radiation band at the resonant frequency of the resonant circuit. The fractional bandwidths at 7 dB return loss (corresponding to approximately 90% of input power radiated) are 2.2% and 1.3%, giving a total radiating bandwidth of 3.5%. The spacing of the radiation bands corresponds to that between the centre of the UMTS uplink and downlink frequency bands, which are centred at 1962.5 MHz and 2140 MHz respectively (the actual frequencies are lower by a factor of 0.875 because the dimensions of the prototype antenna 500 of FIGS. 5 and 6 were scaled up for simplicity of manufacture).

Figure 9:
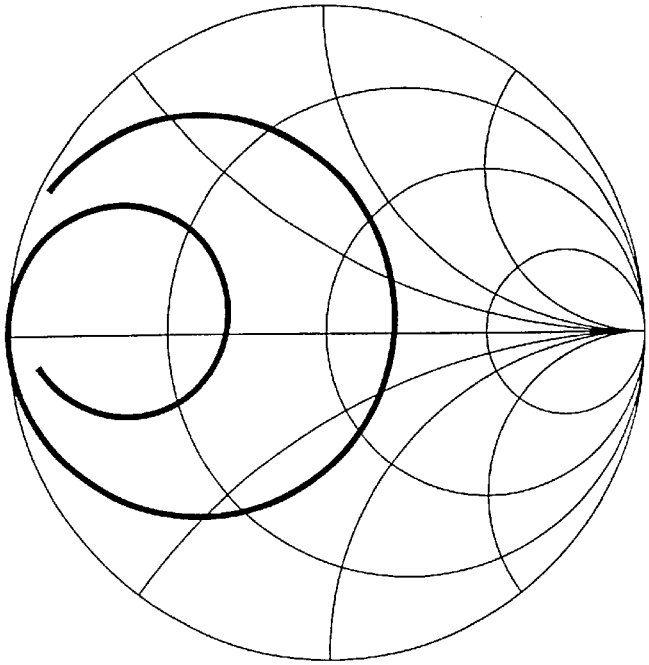
FIG. 9 is a Smith chart showing the simulated impedance of the equivalent circuit of FIG. 7 over the frequency range 1500 to 2000 MHz.

A Smith chart illustrating the simulated impedance of the antenna 500 over the same frequency range is shown in FIG. 9. The match could be improved with additional matching circuitry, and the relative bandwidths of the two resonances could easily be traded, for example by changing the inductance or capacitance of the resonant circuit.

Figure 10:
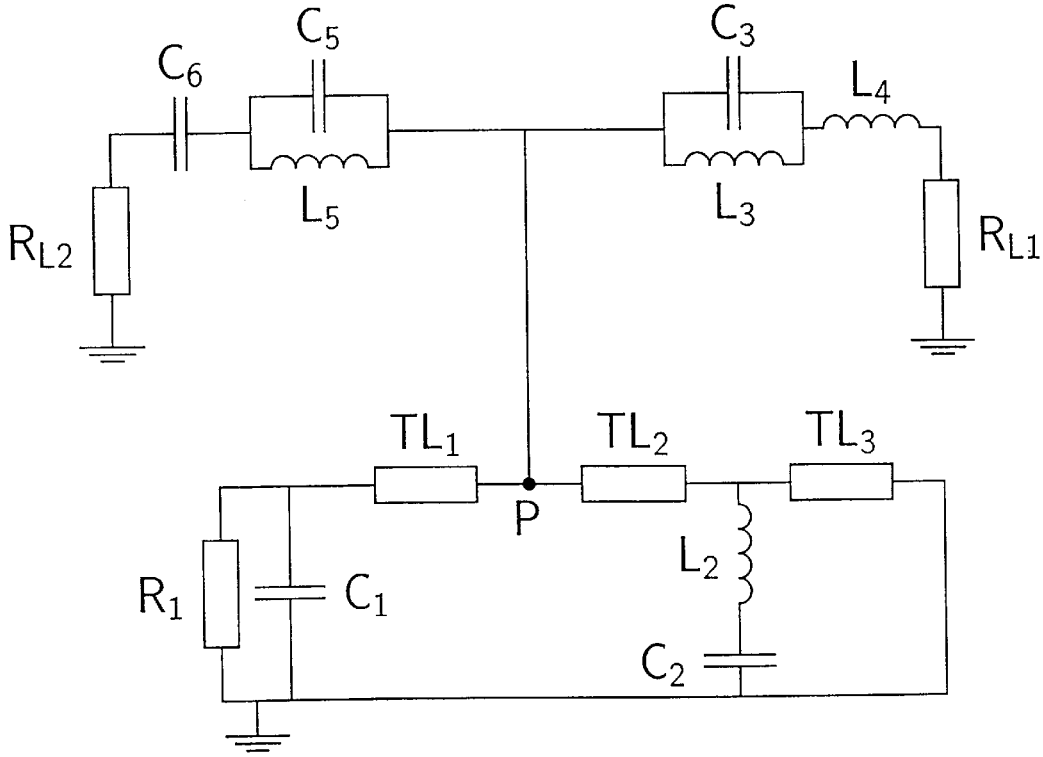
FIG. 10 is an equivalent circuit for modelling an antenna arrangement comprising the dual-band patch antenna of FIGS. 5 and 6 and a distributed diplexer.

The transmission line circuit model of FIG. 7 was modified by the addition of single antenna feed diplexer (i.e. a two input one output multiplexer), as shown in FIG. 10, intended for use with UMTS and DCS1800. The first arm of the diplexer, terminated by a 50 Ω load $R_{L1}$, is designed to pass UMTS frequencies (scaled by a factor of 0.875 to correspond to the dimensions of the prototype antenna 500). It includes a resonant circuit comprising an inductance $L_3$, having a value of 1.025 nH, and a capacitance $C_3$, having a value of 10 pF. The resonant circuit has infinite impedance at its resonant frequency of 1572 MHz, corresponding to the centre of the scaled DCS1800 frequency bands, which it therefore blocks. An inductance $L_4$, having a value of 2.8 nH, ensures that the antenna remains matched for the scaled UMTS frequency bands.

The second arm of the diplexer, terminated by a 50 Ω load $R_{L2}$, is designed to pass DCS1800 frequencies (again scaled by a factor of 0.875). It includes a resonant circuit comprising an inductance $L_5$, having a value of 1.5688 nH, and a capacitance $C_5$, having a value of 5 pF. The resonant circuit has infinite impedance at its resonant frequency of 1797 MHz, corresponding to the centre of the scaled UMTS uplink and downlink frequency bands, which it therefore blocks. A capacitance $C_6$, having a value of 0.7 pF, recovers the match for the scaled DCS1800 frequency band.

Figure 11:
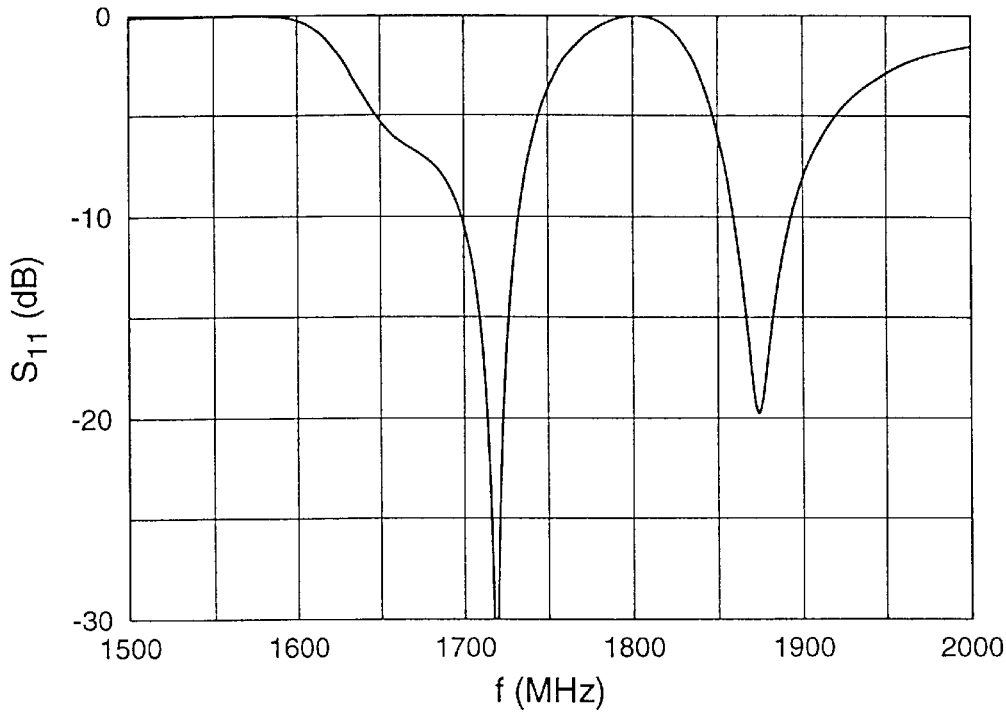
FIG. 11 is a graph of simulated return loss $S_{11}$ in dB against frequency f in MHz for the first multiplexer input to the equivalent circuit of FIG. 10.

FIG. 11 shows the results of simulations for the return loss $S_{11}$ at the first arm of the diplexer for frequencies f between 1500 and 2000 MHz. The two resonant frequencies are virtually unchanged from the equivalent results without the diplexer shown in FIG. 8. However, the fractional bandwidths at 7 dB return loss significantly increased to 3.7% and 2.8%, giving a total radiating bandwidth of 6.5%. This demonstrates that the design of the diplexer circuit can result in significant enhancement of the bandwidth of the antenna 500.

Figure 12:
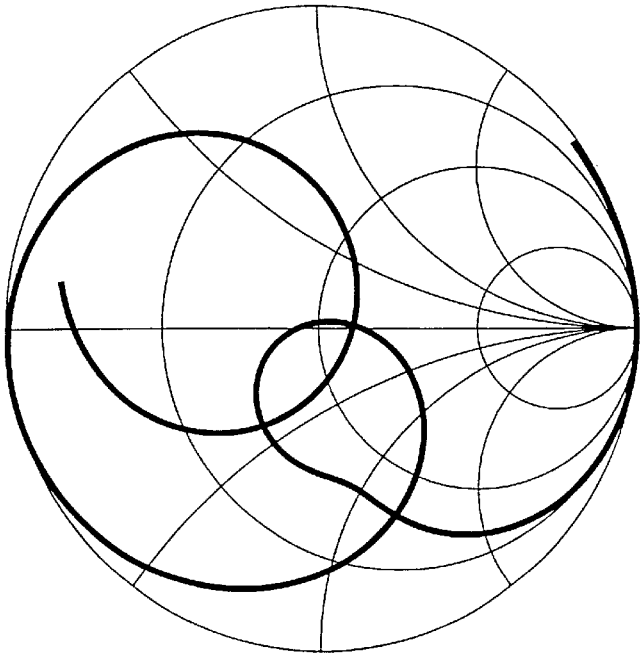
FIG. 12 is a Smith chart showing the simulated impedance of the first multiplexer input of the equivalent circuit of FIG. 10 over the frequency range 1500 to 2000 MHz.

A Smith chart illustrating the simulated impedance of the antenna 500 over the same frequency range is shown in FIG. 12. This demonstrates that the match for both bands is better than without the diplexer (as is also apparent from comparing FIGS. 8 and 11).

Figure 13:
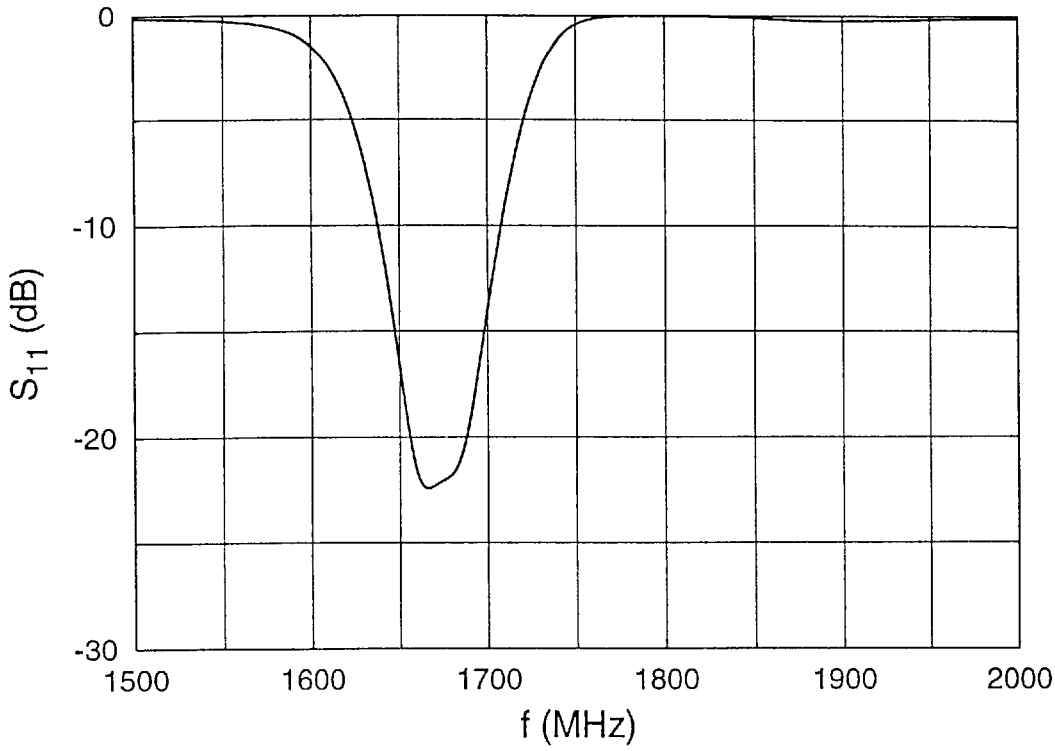
FIG. 13 is a graph of simulated return loss $S_{11}$ in dB against frequency f in MHz for the second multiplexer input to the equivalent circuit of FIG. 10.

FIG. 13 shows the results of simulations for the return loss $S_{11}$ at the second arm of the diplexer for frequencies f between 1500 and 2000 MHz. There is now a single radiation band, having a centre frequency of 1666 MHz and a fractional bandwidth at 7 dB return loss of 5.1%. This demonstrates that the matching and filtering circuitry in the diplexer can be used to fine-tune the resonant frequency of the antenna, here reducing it to slightly below the two natural resonant frequencies of the antenna.

Figure 14:
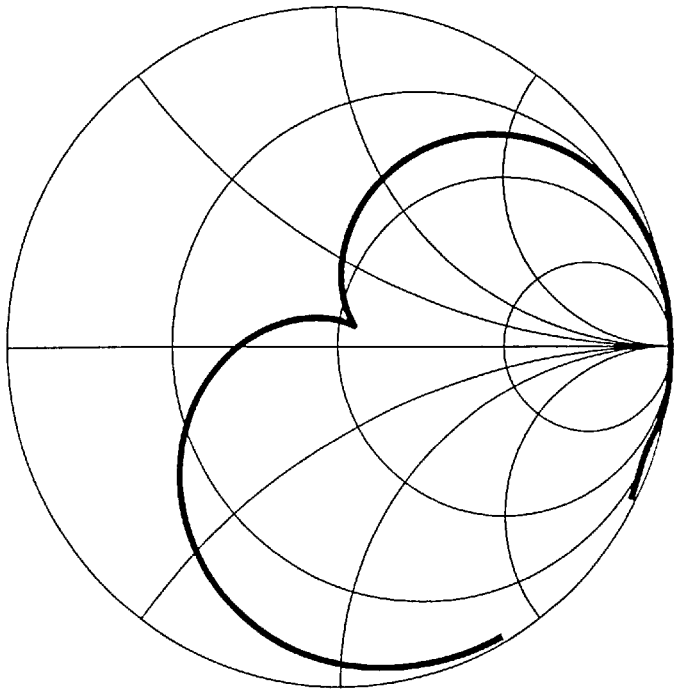
FIG. 14 is a Smith chart showing the simulated impedance of the second multiplexer input of the equivalent circuit of FIG. 10 over the frequency range 1500 to 2000 MHz.

A Smith chart illustrating the simulated impedance of the antenna 500 over the same frequency range is shown in FIG. 14, illustrating that the diplexer circuitry has combined the original two resonances.

Further enhancements to the bandwidth of the antenna 500 are possible with the aid of independent matching and broadbanding circuits. A particular advantage of an arrangement made in accordance with the present invention is that such matching and bandwidth enhancement can be performed independently for each frequency band of operation.

A particular advantage of an arrangement made in accordance with the present invention is that the multiplexer can be implemented very close to the antenna feed or feeds, thereby minimising the effect of parasitic impedances which could otherwise seriously compromise its performance. For example, parasitic capacitance to ground could seriously compromise the open circuits generated by the resonant circuits $L_3$,$C_3$ or $L_5$,$C_5$ at the frequencies that each circuit is designed to block.

From reading the present disclosure, other modifications will be apparent to persons skilled in the art. Such modifications may involve other features which are already known in the design, manufacture and use of antenna arrangements and component parts thereof, and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of features during the prosecution of the present application or of any further application derived therefrom.

In the present specification and claims the word "a" or "an" preceding an element does not exclude the presence of a plurality of such elements. Further, the word "comprising" does not exclude the presence of other elements or steps than those listed.

What is claimed is:

1. An antenna arrangement comprising:

a multiband antenna having at least one feed point; a multiplexer, the multiplexer comprising reciprocal networks and including at least one output coupled to the at least one feed point of the multiband antenna, the multiplexer further comprising at least one input for receiving at least one signal at a first frequency, wherein the coupling between the at least one feed point and the at least one output of the multiplexer has a substantially negligible impedance.

2. The arrangement as claimed in claim 1 wherein the multiplexer is located close to the at least one antenna feed point.

3. The arrangement as claimed in claim 1, wherein the multiplexer further comprises antenna matching circuitry for matching the impedance of an antenna feed point to that of a transceiver port.

4. The arrangement as claimed in claim 1, wherein the antenna has a plurality of feed points, each corresponding to one or more operational frequency bands of the antenna.

5. The arrangement as claimed in claim 4, wherein the multiplexer is distributed between each of the feed points of the antenna.

6. A radio communications apparatus including an antenna arrangement, wherein the antenna arrangement comprises:

a multiband antenna having at least one feed point; a multiplexer, the multiplexer comprising reciprocal networks and including at least one output couple to the at least one feed point of the multiband antenna, the multiplexer further comprising at least one input for receiving at least one signal at a first frequency, wherein the coupling between the at least one feed point and the at least one output of the multiplexer has a substantially negligible impedance.

7. An antenna arrangement comprising:

a multiband antenna having at least one feed point; a multiplexer, the multiplexer comprising resonant circuits and including at least one output coupled to the at least one feed point of the multiband antenna, the multiplexer further comprising at least one input for receiving at least one signal at a first frequency, wherein the coupling between the at least one feed point and the at least one output of the multiplexer has a substantially negligible impedance;

wherein the resonant circuits comprise at least one of an open circuit series LC circuit and a short circuit parallel LC circuit.

8. The antenna arrangement as claimed in claim 7, wherein the multiband antenna includes at least a first and second feed point and the multiplexer includes at least a first and second output respectively coupled to the at least first and second feed points;

wherein the resonant circuits comprise open circuit series LC circuits.

9. The arrangement as claimed in claim 8, wherein the resonant circuits are tuned to be resonant at input frequencies other than those to be passed.

* * * * *